US005284225A

United States Patent [19]

Platt

[11] Patent Number: 5,284,225

[45] Date of Patent: Feb. 8, 1994

[54] LIFT DOOR APPARATUS

[75] Inventor: Terence C. Platt, Binfield, United Kingdom

[73] Assignee: Memco Limited, Berks, United Kingdom

[21] Appl. No.: 948,020

[22] Filed: Sep. 21, 1992

[30] Foreign Application Priority Data

Sep. 23, 1991 [GB] United Kingdom ..... 9120267

[51] Int. Cl.[5] ..... B66B 13/00

[52] U.S. Cl. ..... 187/51; 187/132

[58] Field of Search ..... 187/51, 1 R, DIG. 1, 187/132, 139, 39, 52 R; 250/221

[56] References Cited

U.S. PATENT DOCUMENTS 4,951,786 8/1990 Haraguchi ..... 187/1 R 4,976,337 12/1990 Trett ..... 187/51

FOREIGN PATENT DOCUMENTS 0344404 12/1989 European Pat. Off. ..... 187/51

*Primary Examiner*—D. Glenn Dayoan

*Assistant Examiner*—Kenneth Noland

*Attorney, Agent, or Firm*—Cumpston & Shaw

[57] ABSTRACT

Apparatus for controlling a lift door in which a detection zone (10) is illuminated with an infrared light source (15) and reflected light is received by image sensing device (18). A data processing device (17) is programmed to analyse video information stored in a video memory (22) and a reference field memory (23) so as to distinguish an object approaching the lift doors (1, 2) from an object passing by the lift, and also distinguishes stationary objects in the path of the lift doors (1, 2) from background objects. In a preferred embodiment, a low resolution image sensing device (18) is used and video information is binned and stored in the video memory (22).

8 Claims, 3 Drawing Sheets

Figure 3A:
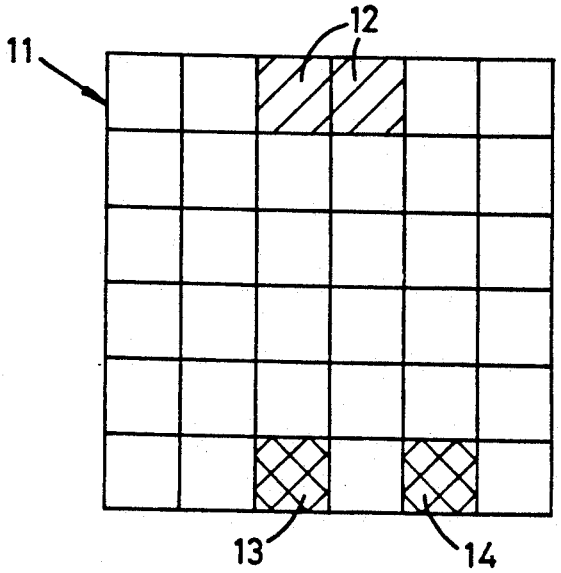

FIG. 1
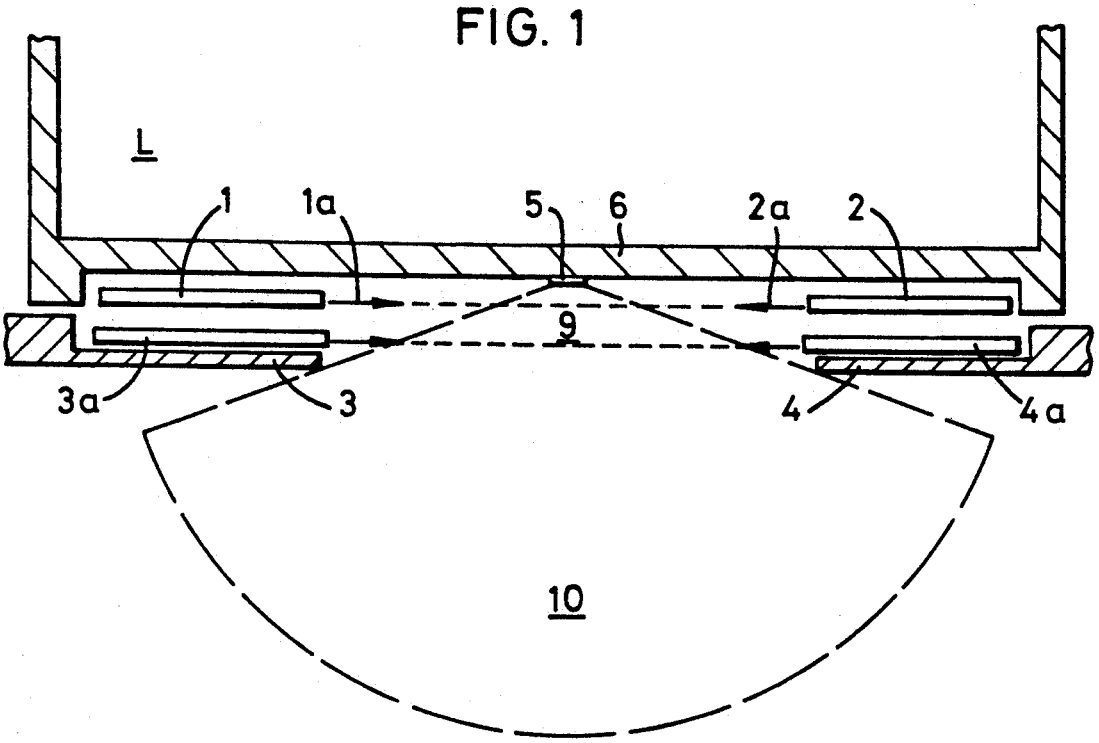
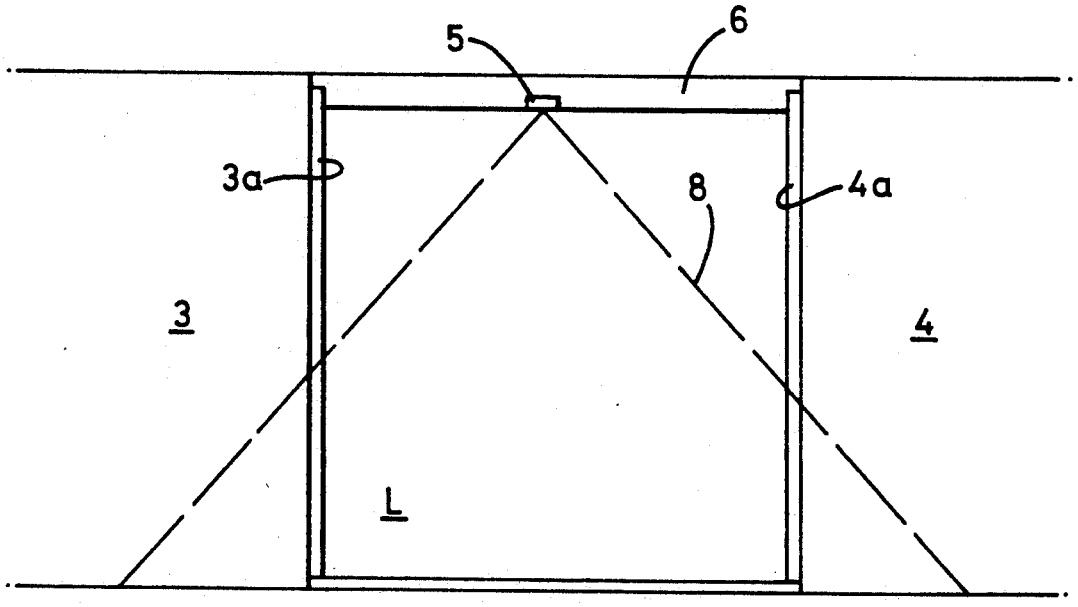
FIG. 2

LIFT DOOR APPARATUS

This invention relates to lift door apparatus in which means are provided for sensing an object and for deriving a signal which is used for controlling the lift door. The invention may be applied where a single lift door closes against a fixed frame member or jamb, or where double lift doors close together. In either case, the lift door travels along a closing path across which a person or an object passes in order to enter or to leave the lift.

Many infrared and optically based proximity detection systems have been designed for use in controlling the operation of a lift door or doors. However, none of these known systems have had the ability to protect the door aperture itself and to observe the area immediately in front of the closing path in order to detect approaching lift passengers. One of the problems facing the invention is to provide lift door apparatus in which it is possible to distinguish approaching passengers so that the lift door control system can be caused to delay door closure to allow for a late arrival to enter the lift. One of the aspects of this problem is to distinguish between a person who may be passing by the lift and a person approaching the lift door in order to enter the lift. A further problem is to distinguish between stationary objects which could intercept a closing lift door and background objects which would not interfere with door operation. Such background objects may vary from floor to floor of a lift shaft and/or may include edges of the lift door or doors.

According to a first aspect of the invention, lift door apparatus comprises:

image sensing means for viewing a zone extending between a closing path of at least one lift door and a position remote from said closing path and for generating an image in the form of a matrix, means for selectively and repetitively scanning a first portion of the matrix corresponding with a first part of said zone which is remote from the closing path of said door, means for storing data representing the scanning of said first portion of the matrix, means for processing the data to determine whether an object in the first part of said zone is a moving object and for distinguishing between moving objects which approach said closing path and which move transversely thereto, and means connected to said data processing means for generating a signal in response to a moving object approaching said closing path, which signal is used to delay closure of said lift door to enable said approaching object to enter the lift.

In the latter apparatus, it is preferred that the scanning means also selectively and repetitively scans a second portion of the matrix, which second portion corresponds to a second part of said zone adjacent said closing path and in which stationary objects can be detected that could otherwise cause an obstruction to closure of said lift door. In this case, the data processing means also distinguishes stationary objects adjacent said closing path in order to generate the signal to prevent closure of the lift door.

In the latter apparatus, the image sensing means is preferably a compact solid state image sensor with high sensitivity in the infrared region and high resolving power. Such a sensor can be mounted, for example, in a compact housing in the door lintel of a lift car, so that it is arranged to view the zone which includes the space adjacent the closing path of the door and/or space between the door and the closing frame (or another door) as well as an area stretching out into, e.g. a hall way in front of the lift door.

Suitably, an infrared light source is used to illuminate the zone and a narrow band infrared filter is preferably used in front of the viewing aperture of the image sensing means. The use of infrared light eliminates confusion due to variations in ambient lighting conditions and also allows the apparatus to work correctly even in darkness.

The lift door apparatus according to the first aspect of the invention incorporates scanning means to scan first (and preferably also second) portions of the matrix, since this is one way of enabling a reduction to be made in the processing time required to sample, store and analyse the required data. In the second aspect of the invention (as described below), a different approach is adopted. Instead of scanning portions of a high resolution matrix, a low resolution matrix is fully scanned and pixel information is "binned" in video memory. This distinction and its relative advantages will become more apparent from the following description.

According to a second aspect of the invention, lift door apparatus comprises:

image sensing means for viewing a zone extending between a closing path of at least one lift door and a position remote from said closing path, and for generating an image in the form of a low resolution pixel matrix, scanning means for selectively and repetitively scanning the matrix, binning means for receiving the output of the scanning means and for causing data, relating to different groups of pixels in the matrix, to be stored in respective portions of data storing means, means for processing the stored data to determine whether an object in said zone is a moving object and for distinguishing between moving objects which approach said closing path and which move transversely thereto, and trigger means connected to the data processing means for generating a trigger signal when the data processing means determines that the moving object is approaching said closing path, said trigger signal being used to delay closure of said lift door to enable said approaching object to enter the lift.

Preferably, the data processing means is also capable of determining whether a stationary object, in said zone could cause an obstruction to prevent closure of the lift door and is also capable of causing the trigger means to generate the trigger signal accordingly. Such apparatus also preferably includes reference data storing means for storing data, derived from the scanning of the matrix, representing images of fixed and/or movable background objects, which objects would not normally interfere with closure of the lift door. A fixed background object may be, for example, a plant holder located outside the lift door on a particular floor of the lift shaft in which the lift travels. A movable background object would include, for example, a lift door which moves towards or away from a closing frame (which frame is a fixed background object) or lift doors which open and close relative to one another. The lift door or doors would intercept the field of view of image sensing means mounted in the lift (i.e. inside the door or doors), but would be "seen" as a frame edge (to be ignored) when determining the presence of an approaching object, or the presence of a stationary object which could interfere with door closure.

In the apparatus according to the second aspect of the invention, the detection zone is preferably illuminated by repetitively generated bright and short pulses of infrared light. This enables the electronic shutter facility of a modern CCD detector, which could form the image sensing and scanning means, to be used in sampling objects in the detection zone only during the period within which the infrared radiation pulse is switched on. A narrow band optical filter is preferably positioned in front of a lens in the image sensing means so as to receive infrared light reflected from objects in the detection zone. By using infrared illumination advantage can be taken of the high reflectivity, in the near infrared spectrum, of human skin. Moreover, most coloured dyes are also very reflective in the near infrared spectrum and this also enables the image sensing means to "see" most fabrics very well. A heavily clothed figure should therefore be seen almost as well as exposed skin, and the doors can be controlled appropriately.

The latter arrangement also enables readily available infrared diode emitters to be used with short duty cycles during which the optical output is boosted and high heat dissipation can be tolerated for a short time. This avoid the problem that high power infrared emitting diodes are not readily available at reasonable cost. The invention can be embodied so as to make use of readily available lower cost parts. Moreover, ambient light effects are minimised, by the short exposure of the infrared pulses, and shadows and reflected sunlight do not pose a serious problem.

The advantage of using of the low resolution pixel matrix and the binning means, which causes groups of pixel data to be stored in respective portions of memory, will now be explained.

The image sensing and scanning means provides information similar to frames of video fields. These frames of information would normally need to be stored, on a pixel-by-pixel basis, so that suitably programmed data processing means could compare the stored information on a frame-by-frame basis as well as with stored reference frames. As a television image, for example, is usually of quite high resolution (typically 500 picture elements per scan line), this would lead to problems of image storage and processing time. One picture, for example, may consist of about 128,000 discrete elements and a large amount of memory would be needed for its storage. The need to store reference frames of information for distinguishing background objects further compounds the problem of storage. However, in the preferred lift door apparatus, it is assumed to be unnecessary to resolve objects smaller than about 10 mm diameter within a door opening of, say, 1 meter width. This means that an image of 100×100 pixels resolution should be more than adequate, and this reduces the storage and processing requirements dramatically. CCD resolution is thereby advantageously reduced and an additional advantage of increased sensitivity is obtained by "binning" pixels during readout, where groups of 5×2 pixels are summed into each portion or cell of memory. The sensitivity of the sensing means is improved by a factor of 10× and this further effectively enhances the performance of the illuminating diodes.

As the sensing means is best located within the lift in order to scan detection zones on each floor, the lift doors would then close through the field of view of the sensing means and could be seen as a source of spurious detections if the doors are not ignored by the sensing means or software in the data processing means. This can be dealt with by attaching small retroreflective patches to the doors at the extreme top and bottom ends, such patches would be seen as bright dots in the field of view and would enable the software to define the door outline. Thus only objects adjacent a door edge, or between the door edges would be seen as being in a potentially hazardous location.

On installation of the lift door apparatus, a series of reference fields are preferably recorded into an electrically erasable read-only memory, one for each floor of the building. The sensing means is then selectively switched into its operating mode, by the data processing means, for the appropriate floor and the data processing means then compares the respective reference field with that which is visible when the doors open. Sensitive zones in the field of view are defined by software in the data processing means so that objects inside and outside the door are ignored, either if they are recognised within the reference field, or are not in the reference but are not approaching the door. If an object is seen with a well-defined trajectory towards the door, then the apparatus will hold the doors open until the object has passed through. This can be deemed the "approach detection" mode of the apparatus.

If a non-reference object is within the "between doors" zone, then the trigger signal will be issued whether the object is moving or stationary. To avoid deliberate obstruction of the doors holding then open for long periods, this trigger signal can be allowed to decay after several seconds and thereby allow the door to try to close. However, any movement of the object will be interpreted as a new valid trigger signal and so stop the doors again. This can be deemed a "dynamic obstruction" mode of the apparatus and will avoid any animate object being trapped by the closing door.

Figure 3B:
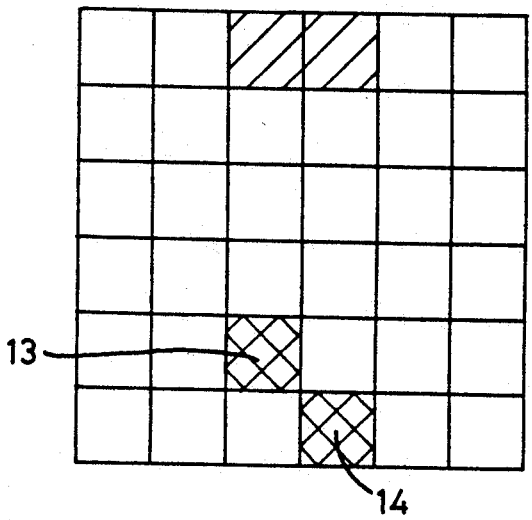
Figure 3C:
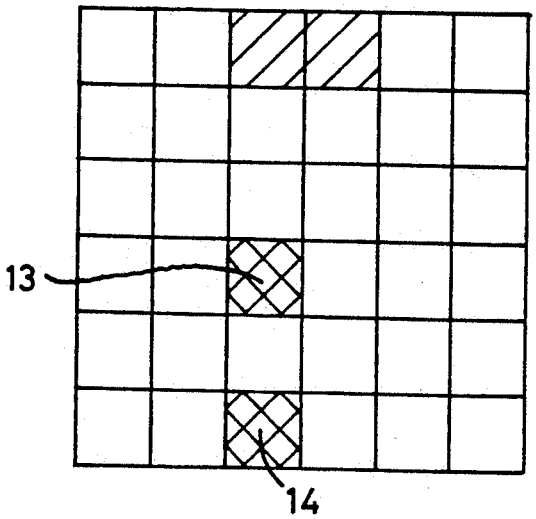
Figure 4:
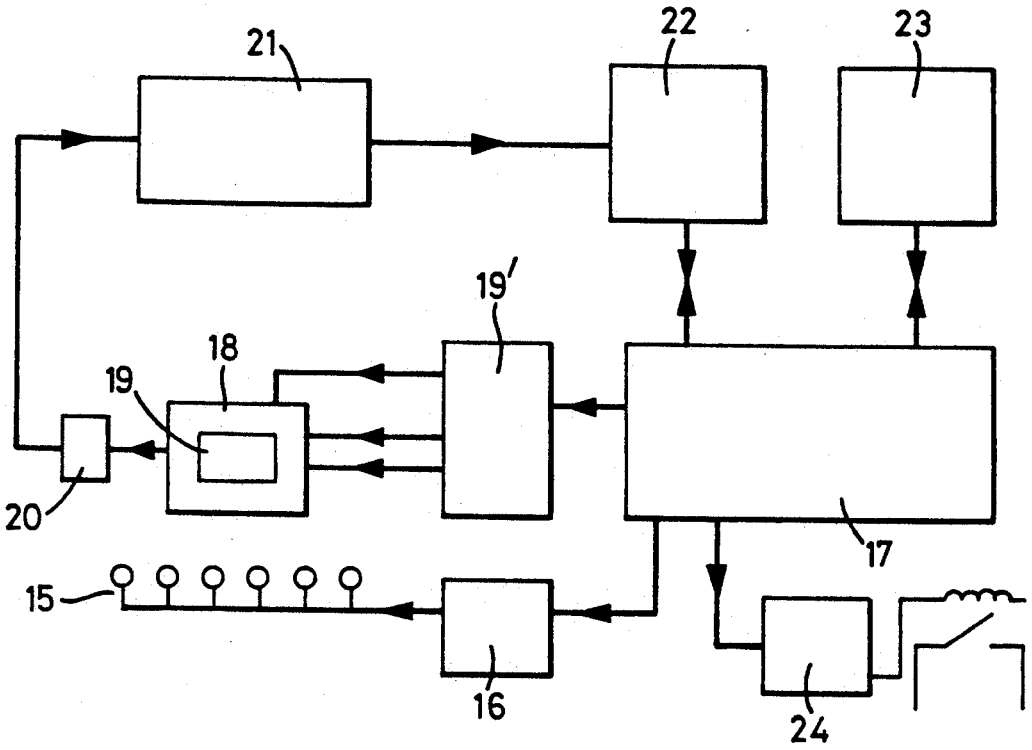

Embodiments of the invention will now be described with reference to the accompanying schematic Drawings, in which:

FIG. 1 is a sectional view through the front of a lift car showing two pairs of doors closing towards each other, one pair in the lift and the other on the lift floor, FIG. 2 is a side elevation of the lift entrance depicted by FIG. 1, FIGS. 3*a*–3*c* show a matrix of image sensing means used in the embodiment of FIGS. 1 and 2, and FIG. 4 is a block diagram of a preferred embodiment of the invention.

Referring to FIGS. 1–3, a lift car L has lift doors 1, 2 which close slidably together as indicated by the arrows 1*a*, 2*a*. The doors 1, 2 run on tracks (not shown), as will be known to those skilled in the art. The drawing has been simplified, for the sake of explanation, and is hence only schematic. The floor at which the lift has stopped has walls 3, 4 which also support tracks for doors 3*a*, 4*a* that close the lift opening when the lift moves to the next floor. Image sensing means 5 is mounted in a door lintel 6 of the lift car L so as to scan a semi-conical region 8 which encompasses a space which is adjacent the closing paths 9 of doors 1, 2 and 3*a*, 4*a*, and extends outwardly in front of the closing path 9. This scanning region is indicated by the broken lines in FIGS. 1 and 2.

The image sensing means 5 includes a matrix 11 (shown in FIG. 3) in which the relative positions of objects in the spaces 8 and 10 can be detected. This matrix also enables moving objects to be distinguished from stationary objects. A large stationary object (or two stationary objects) are depicted by the sectional line shading 12 in the first row of the matrix 11 in each of FIGS. 3*a*, 3*b* and 3*c*. As the objects do not move, their positions in the matrix remain the same as shown in FIGS. 3*a*, 3*b* and 3*c*. However, the cross-hatched squares 13 and 14 represent moving objects and their positions in the matrix changes accordingly with time. Object 13 is approaching the lift door because, with the passage of time, its position in the matrix moves closer to the first row which is directly adjacent the closing path of the door. However, object 14 is moving transversely to this direction, since its position in the matrix always remains in the last row whilst it moves, with time, across the matrix from right to left.

Data processing means, such as the microcontroller 17 shown in FIG. 4 (described in more detail below) is programmed to analyse stored data with respect to time so as to determine relative positions of objects in the matrix with respect to the closing path of the door. The processing means also determines whether or not the detected objects are stationary or moving and, if they are moving, whether or not they are approaching the closing path of the door or travelling transverse thereto. Signal generating means, responsive to the data processing means, is triggered when an object approaches the lift doors whereby a signal is generated to delay closure of the lift doors until the approaching object has entered the lift.

In the case of detecting a stationary object, the signal processing means also generates the signal to delay lift door closure.

Referring to FIG. 4, a preferred embodiment of the invention employs an array of infrared diodes 15 which are attached to a convenient part of the door lintel 6 of the lift car 7 (FIG. 2). These diodes 15 illuminate the scanning space or detection region 10 and are driven by a diode pulser 16 which is actuated by a signal from microcontroller 17. Microcontroller 17 analyses the stored data and provides outputs for operating the lift door apparatus. A CCD imager 18, with an IR filter 19 receives IR light reflected from objects in the scanning zone. The imager 18 may be of known construction or purpose-made. This device generates images of objects in the scanning zone in the form of a low resolution pixel matrix and is controlled by clock drivers 19 connected to microcontroller 17. The clock drivers 19 are operated so as to provide a "shutter input" to imager 18 whereby the latter device samples the scanning zone only during a brief pulse of infrared light from diodes 15. The output of imager 18 is supplied to an amplifier 20 which supplies an amplified signal to circuitry 21 for digitising and "binning" pixel values intermittently stored in video memory 22 and derived from the imager matrix 18.

Reference field memory 23 contains stored reference images of each lift landing so as to identify known background objects on each floor (both inside and outside the lift doors). The video memory 22 and reference field memory 23 are both connected to microcontroller 17 which is programmed to recognise background objects which would not normally interfere with lift operation. The microcontroller may be programmed to compare respective frames of reference information with the scene viewed by the sensing means on each floor. The microcontroller 17 is also programmed to distinguish stationary objects from moving objects, so that stationary objects which could obstruct closure of the lift door can be recognised and the door prevented from closing. Microcontroller 17 is further programmed to distinguish moving objects which approach the closing path of the lift door from objects which move transversely thereto. After analysing images matrices generated from the scanning zone over a predetermined period, the microcontroller provides a drive signal to relay 24 for closing the lift door, or delaying closure as the case may be. The programming of the microcontroller and the structure and operation of lift door control devices will be generally known to those skilled in the art.

I claim:

1. Lift door apparatus comprising:

optical image sensing means for viewing a zone extending between a closing path of at least one lift door and a position remote from said closing path and for generating an image of the zone in the form of a matrix, corresponding means for selectively and repetitively scanning a first portion of the matrix corresponding with a first part of said zone which is remote from the closing path of said door;

means for storing data representing the scanning of said first portion of the matrix, means for processing the data to determine whether an object in the first part of said one is a moving object and for distinguishing between moving objects which approach said closing path and which move transversely thereto, and means connected to said data processing means for generating a signal in response to a moving object approaching said closing path, which signal is used to delay closure of said lift door to enable said approaching object to enter the lift.

2. Lift door apparatus comprising:

image sensing means for viewing a zone extending between a closing path of at least one lift door and a position remote from said closing path and for generating an image in the form of a matrix, means for selectively and repetitively scanning a first portion of the matrix corresponding with a first part of said zone which is remote from the closing path of said door; and a second portion of the matrix, which second portion corresponds to a second part of said zone adjacent said closing path and in which stationary objects can be detected that could otherwise cause an obstruction to closure of said lift door, means for storing data representing the scanning of said first portion of the matrix, data processing means for processing the data to determine whether an object in the first part of said zone is a moving object, for distinguishing between moving objects which approach said closing path and which move transversely thereto, and for distinguishing stationary objects adjacent said closing path in order to generate the signal to prevent closure of the lift door, and means connected to said data processing means for generating a signal in response to a moving object approaching said closing path, which signal is used to delay closure of said lift door to enable said approaching object to enter the lift.

3. Apparatus according to claim 2 including a source of infrared light for illuminating said zone and in which the image sensing means is a solid state image sensor with high sensitivity in the infrared region and high resolving power, said sensor being mounted in a lift car and arranged to view the zone which includes the space adjacent the closing path of the door and/or space between the door and the closing frame (or another door) as well as an area stretching out into, e.g. a hall way in front of the lift door.

4. Lift door apparatus comprising:

image sensing means for viewing a zone extending between a closing path of at least one lift door and a position remote from said closing path, and for generating an image in the form of a low resolution pixel matrix, scanning means for selectively and repetitively scanning the matrix, binning means for receiving the output of the scanning means and for causing data, relating to different groups of pixels in the matrix, to be stored in respective portions of data storing means, means for processing the stored data to determine whether an object in said zone is a moving object and for distinguishing between moving objects which approach said closing path and which move transversely thereto, and trigger means connected to the data processing means for generating a trigger signal when the data processing means determines that the moving object is approaching said closing path, said trigger signal being used to delay closure of said lift door to enable said approaching object to enter the lift.

5. Apparatus according to claim 4 wherein the data processing means is also capable of determining whether a stationary object, in said zone could cause an obstruction to prevent closure of the lift door and is also capable of causing the trigger means to generate the trigger signal accordingly.

6. Apparatus according to claim 5 further including reference data storing means for storing data, derived from the scanning of the matrix, representing images of fixed and/or movable background objects, which objects would not normally interfere with closure of the lift door, said data processing means also being programmed to ignore said images of background objects.

7. Apparatus according to claim 6 in which the reference data is stored for each floor served by the lift, said data processing means selectively comparing the respective reference data for a floor with the scene view by the imaging means of the same floor.

8. Apparatus according to claim 4 in which said zone is illuminated by a source of infrared light and further including pulse drive means connected to said source so as to illuminate said zone with pulses of infrared light, said pulse drive means being controlled by the data processing means and said imaging sensing means sampling infrared light reflected from objects in said zone only during periods within which said zone is illuminated.

* * * * *